US010809034B2

(12) United States Patent
Lee

(10) Patent No.: US 10,809,034 B2
(45) Date of Patent: Oct. 20, 2020

(54) BARREL SYSTEM FOR A FIREARM

(71) Applicant: APEX TACTICAL SPECIALTIES, INC., Peoria, AZ (US)

(72) Inventor: Randall M. Lee, Peoria, AZ (US)

(73) Assignee: Apex Tactical Specialties, Inc., Peoria, AZ (US)

( * ) Notice: Subject to any disclaimer, the term of this patent is extended or adjusted under 35 U.S.C. 154(b) by 0 days.

(21) Appl. No.: 16/409,104

(22) Filed: May 10, 2019

(65) Prior Publication Data

US 2019/0271521 A1 Sep. 5, 2019

Related U.S. Application Data

(60) Division of application No. 15/294,629, filed on Oct. 14, 2016, now Pat. No. 10,330,421, which is a continuation-in-part of application No. 14/746,845, filed on Jun. 23, 2015, now Pat. No. 9,739,558.

(51) Int. Cl.
*F41A 21/48* (2006.01)
*F41A 11/00* (2006.01)

(52) U.S. Cl.
CPC ..... *F41A 21/488* (2013.01); *F41A 11/00* (2013.01)

(58) Field of Classification Search
CPC ..... F41A 11/00; F41A 21/48; F41A 21/488; F41A 21/00; F41A 21/02; F41A 21/22; F41A 21/24
USPC ..... 42/75.1, 76.01, 76.1; 89/163
See application file for complete search history.

(56) References Cited

U.S. PATENT DOCUMENTS 1,427,413 A * 8/1922 Pieper ..... F41A 11/00 89/196
1,738,751 A * 12/1929 Bluehdorn ..... F41A 3/86 89/163
2,664,786 A * 1/1954 Guisasola ..... F41A 5/04 89/163
2,846,925 A * 8/1958 Norman ..... F41A 17/38 89/145
2,887,810 A * 5/1959 Norman ..... F41A 21/488 42/75.02

(Continued)

OTHER PUBLICATIONS

Paul, Installing the Apex Semi Drop-In Barrel, Dec. 3, 2015, Apex Tactical Specialties, pp. 1-5 (Year: 2015).*

(Continued)

*Primary Examiner* — Stephen Johnson
*Assistant Examiner* — Benjamin S Gomberg
(74) *Attorney, Agent, or Firm* — Fitch, Even, Tabin & Flannery LLP

(57) ABSTRACT

A barrel assembly for use in a semiautomatic firearm, including a barrel and a takedown lever. A rear portion of the barrel includes a follower lug and a rear lug extending from an underside of the rear portion. A pin of the takedown lever includes a notch with a vertical face configured to contact a vertical face of the follower notch when the firearm is in the locked position. The rear lug is configured to be supported by a portion of a locking block of the firearm prior to firing and during a portion of the recoil period. A fitting pad extending downward from a rear lug of the barrel can be adjusted to provide a customized fit of the barrel to a frame of the firearm. The modifications to the barrel assembly result in increased dwell time and accuracy of the firearm.

12 Claims, 12 Drawing Sheets

(56) References Cited

U.S. PATENT DOCUMENTS

| | | | | | |
|---|---|---|---|---|---|
| 2,921,503 | A * | 1/1960 | Browning | F41A 15/12 | 89/195 |
| 3,745,881 | A * | 7/1973 | Roy | F41A 3/64 | 89/163 |
| 3,756,120 | A * | 9/1973 | Roy | F41A 5/04 | 89/163 |
| 4,031,808 | A | 6/1977 | Raville | | |
| 4,253,377 | A * | 3/1981 | Arnett | F41A 3/86 | 42/25 |
| 4,361,975 | A * | 12/1982 | Wilhelm | F41A 19/48 | 42/69.01 |
| 4,539,889 | A * | 9/1985 | Glock | F41A 5/04 | 89/147 |
| 4,594,935 | A * | 6/1986 | Smith | F41A 17/36 | 42/75.02 |
| 5,024,139 | A * | 6/1991 | Knight, Jr. | F41A 5/06 | 42/70.08 |
| 5,050,481 | A | 9/1991 | Knight, Jr. | | |
| 5,216,191 | A * | 6/1993 | Fox | F41A 3/12 | 42/70.05 |
| 5,225,610 | A | 7/1993 | Uria | | |
| 5,415,075 | A * | 5/1995 | Moon | F41A 19/35 | 89/163 |
| 5,581,046 | A * | 12/1996 | Weldle | F41A 5/04 | 89/196 |
| 5,669,169 | A | 9/1997 | Schmitter | | |
| 5,741,996 | A * | 4/1998 | Ruger | F41A 3/66 | 89/196 |
| 5,829,180 | A * | 11/1998 | Leiter | F41A 33/00 | 42/77 |
| 5,906,066 | A * | 5/1999 | Felk | F41A 3/04 | 42/69.02 |
| 6,276,252 | B1 * | 8/2001 | Dionne | F41A 3/86 | 42/77 |
| 6,363,831 | B2 * | 4/2002 | Gussalli Beretta | F41A 5/04 | 89/163 |
| 6,665,973 | B1 * | 12/2003 | Peev | F41A 19/15 | 42/69.01 |
| 6,993,864 | B1 * | 2/2006 | O'Clair | F41A 3/14 | 42/71.02 |
| 7,392,611 | B2 | 7/2008 | Curry | | |
| 7,617,628 | B2 | 11/2009 | Curry | | |
| 9,739,558 | B2 | 8/2017 | Lee | | |
| 10,330,421 | B2 * | 6/2019 | Lee | F41A 11/00 | |
| 2011/0289813 | A1 * | 12/2011 | Serandour | F41A 11/02 | 42/76.01 |
| 2017/0030673 | A1 | 2/2017 | Lee | | |

OTHER PUBLICATIONS

USPTO; Restriction Requirement for U.S. Appl. No. 14/746,845 dated Apr. 21, 2016.

Brandon Louis Clark; Effect of Barrel Length on the Muzzle Velocity and Report from a Mosin-Nagant 7.62×54R Rifle; May 2011; University of South Florida, 40 pages.

Lee; U.S. Appl. No. 15/294,629, filed Oct. 14, 2016.

Lee; U.S. Appl. No. 15/648,443, filed Jul. 12, 2017.

Lee; U.S. Appl. No. 14/746,845, filed Jun. 23, 2015.

USPTO; Advisory Action for U.S. Appl. No. 15/294,629 dated Nov. 9, 2018.

USPTO; Examiner Interview Summary for U.S. Appl. No. 15/648,443 dated Apr. 15, 2019.

USPTO; Final Office Action for U.S. Appl. No. 15/648,443 dated Feb. 22, 2019.

USPTO; Final Office Action for U.S. Appl. No. 15/294,629 dated Aug. 10, 2018.

USPTO; Final Office Action for U.S. Appl. No. 14/746,845 dated Feb. 8, 2017.

USPTO; Non-final office action for U.S. Appl. No. 14/746,845 dated Aug. 8, 2016.

USPTO; Non-final Office Action for U.S. Appl. No. 15/294,629 dated Feb. 5, 2018.

USPTO; Non-final office action for U.S. Appl. No. 15/648,443 dated Aug. 2, 2018.

USPTO; Notice of Allowability for U.S. Appl. No. 15/294,629 dated Apr. 5, 2019.

USPTO; Notice of Allowance for U.S. Appl. No. 14/746,845 dated Apr. 18, 2017.

USPTO; Notice of Allowance for U.S. Appl. No. 15/294,629 dated Feb. 11, 2019.

USPTO; Restriction Requirment for U.S. Appl. No. 15/294,629 datd Nov. 13, 2017.

YouTube; "Installing the Apex Grade Semi Drop-In M&P Barrel"; https://www.youtube.com/watch?v=rL9y1F-uCYE; published Dec. 5, 2015 (downloaded Nov. 7, 2016).

USPTO; Non-Final Office Action for U.S. Appl. No. 15/648,443 dated May 28, 2019.

USPTO; Final Office Action for U.S. Appl. No. 15/648,443 dated Nov. 26, 2019.

USPTO; Advisory Action for U.S. Appl. No. 15/648,443 dated Jan. 28, 2020.

USPTO; Non-Final Office Action for U.S. Appl. No. 15/648,443 dated Apr. 9, 2020.

* cited by examiner

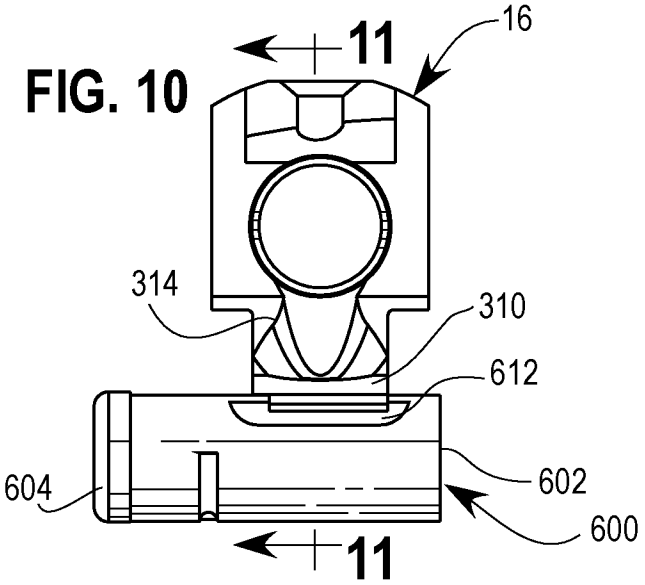
FIG. 10
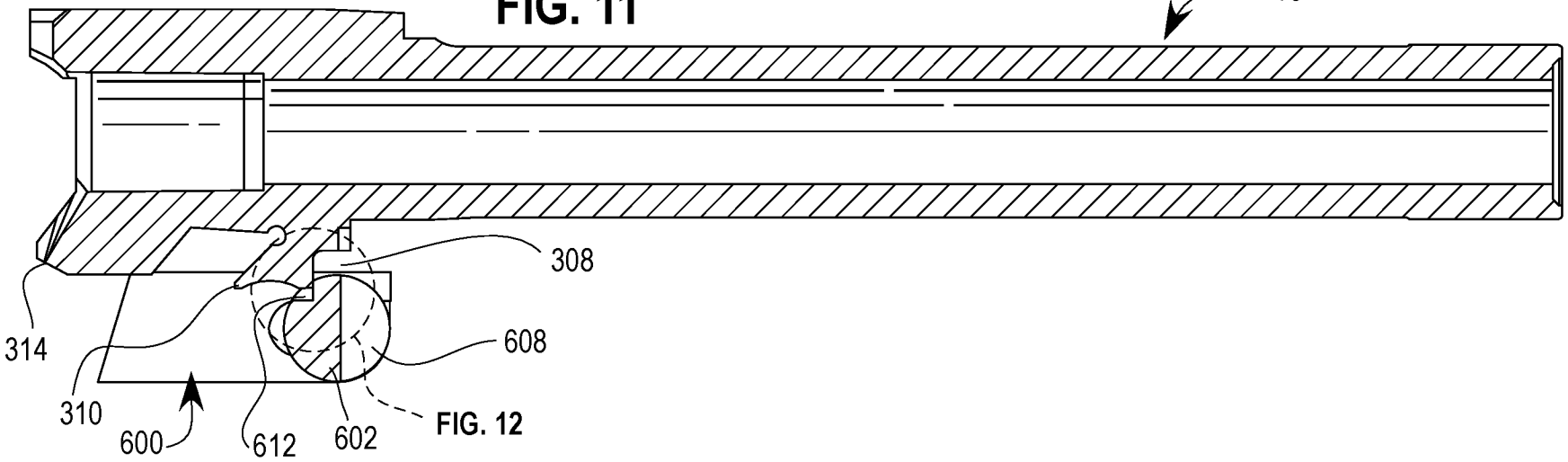
FIG. 11
FIG. 12

BARREL SYSTEM FOR A FIREARM

This application is a divisional of U.S. application Ser. No. 15/294,629, filed Oct. 14, 2016, for BARREL SYSTEM FOR A FIREARM, which is a continuation-in-part of U.S. application Ser. No. 14/746,845, filed Jun. 23, 2015, now U.S. Pat. No. 9,739,558, for BARREL SYSTEM FOR A FIREARM, both of which are incorporated in their entirety herein by reference.

BACKGROUND OF THE INVENTION

1. Field of the Invention

The present invention relates generally to semi-automatic firearms, and more specifically to barrels and takedown levers for semi-automatic firearms.

2. Discussion of the Related Art

Some semiautomatic pistols utilize a short-recoil mechanism, where both the barrel and slide move together rearward upon discharge of the firearm. Prior to firing of the cartridge, the barrel is engaged to the slide by a locking mechanism, in some embodiments including a locking block. After firing, the recoil force drives both the barrel and the slide rearward, but since they are in engagement, the extraction of the casing has not started. After the initial recoil period has passed, an actuator (in some embodiments an upper projection of the locking block that engages with a portion of the barrel) begins to disengage the barrel from the slide. The rearward movement of the barrel is arrested, while the slide continues rearward and begins extraction of the casing using its kinetic energy and the residual gas pressure in the barrel. The slide continues until full rearward travel is reached.

Modern semi-automatic firearms may include a takedown lever. One use of the takedown lever is for assembling and disassembling the firearm. In one position the takedown lever prevents removal of the slide assembly, but when the takedown lever is manually positioned out of the retention position the slide and barrel assembly are removable without tools.

In some firearm configurations, the takedown lever is also involved in the firing process. In some takedown lever designs, the internal portion of the takedown lever can interact with the barrel during the firing process. The interaction between the takedown lever and the barrel during firing may cause the barrel to skew out of alignment during firing, adversely affecting the accuracy of the firearm. Additionally, the interaction may cause the barrel to drop out of battery after firing.

SUMMARY OF THE INVENTION

Several embodiments of the invention advantageously address the needs above as well as other needs by providing a barrel for a firearm, comprising: a rear lug extending downward from an underside of a rear portion of the barrel, the rear lug including a fitting pad projecting downward from a portion of the rear lug proximate to a front of the barrel and including a horizontal fitting pad surface on the underside of the fitting pad, wherein the fitting pad is configured to be supported on a portion of a locking block of the firearm during a length of time during recoil.

In another embodiment, the invention can be characterized as a method for fitting a barrel to a firearm, the barrel including a rear lug extending downward from an underside of a rear portion of the barrel, the rear lug including a fitting pad projecting downward from a portion of the rear lug proximate to a front of the barrel and including a horizontal fitting pad surface on the underside of the fitting pad, whereby a distance the fitting pad projects downward is a fitting pad height, comprising the steps of: installing the barrel in a slide of the firearm; installing the slide on a frame of the firearm; positioning the slide such that the firearm is not in battery and any forward movement of the slide will drop the firearm into battery; applying a forward force to the slide, whereby the firearm is dropped into battery; determining a magnitude of the force; and when the magnitude of the force is greater than 2 pounds, removing the barrel from the firearm and evenly removing a portion of the height of the fitting pad.

In a further embodiment, the invention may be characterized as a method for fitting a barrel to a firearm, the barrel including a rear lug extending downward from an underside of a rear portion of the barrel, the rear lug including a fitting pad projecting downward from a portion of the rear lug proximate to a front of the barrel, whereby a distance the fitting pad projects downward is a fitting pad height, and including a horizontal fitting pad surface on the underside of the fitting pad, comprising the steps of: applying marking dye to the fitting pad surface; installing the barrel in a slide of the firearm; installing the slide on a frame of the firearm; placing the slide in the battery position; removing the barrel from the firearm; determining if the marking dye has been burnished; and in response to determining that the marking dye has been burnished, evenly removing a portion of the height of the fitting pad.

BRIEF DESCRIPTION OF THE DRAWINGS

The above and other aspects, features and advantages of several embodiments of the present invention will be more apparent from the following more particular description thereof, presented in conjunction with the following drawings.

FIG. 10 is a front elevational view of the barrel assembly.

FIG. 11 is a cross-sectional view of the barrel assembly.

Figure 1:
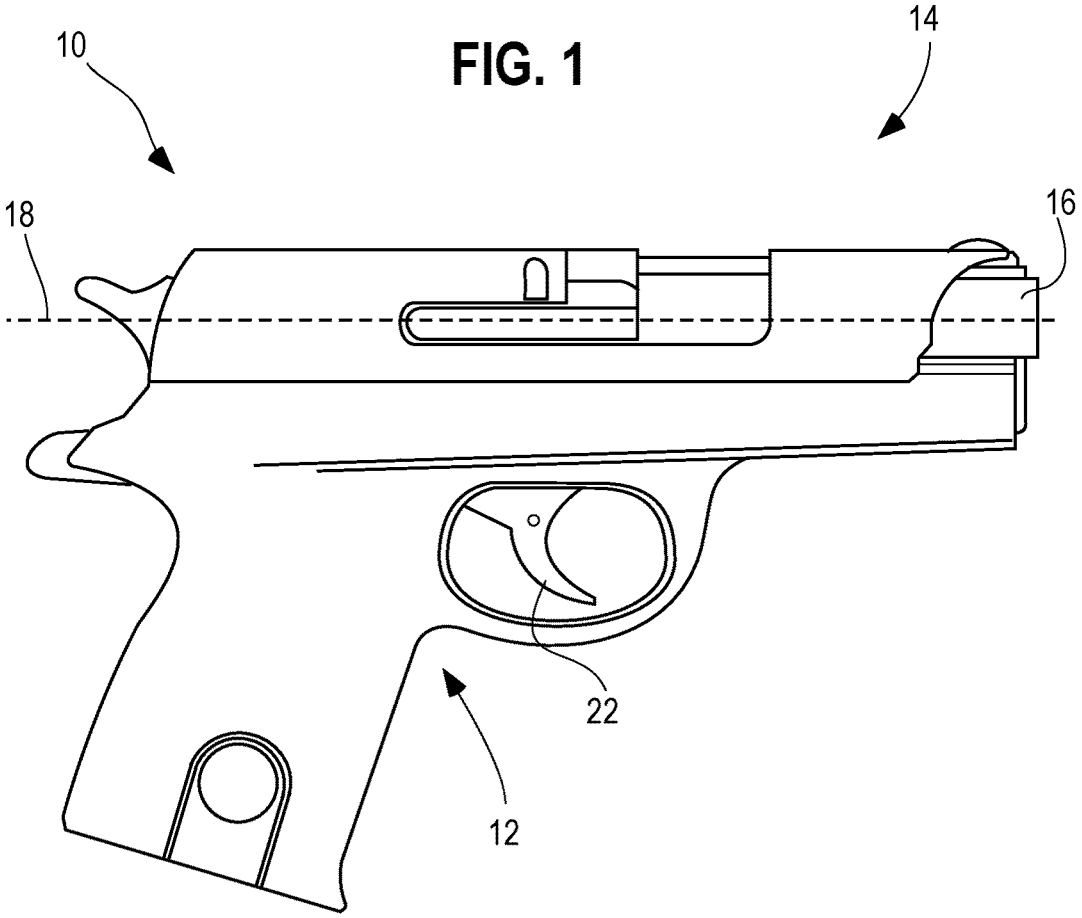
FIG. 1 is a side elevational view of a firearm in the locked position, in accordance with an embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 2:
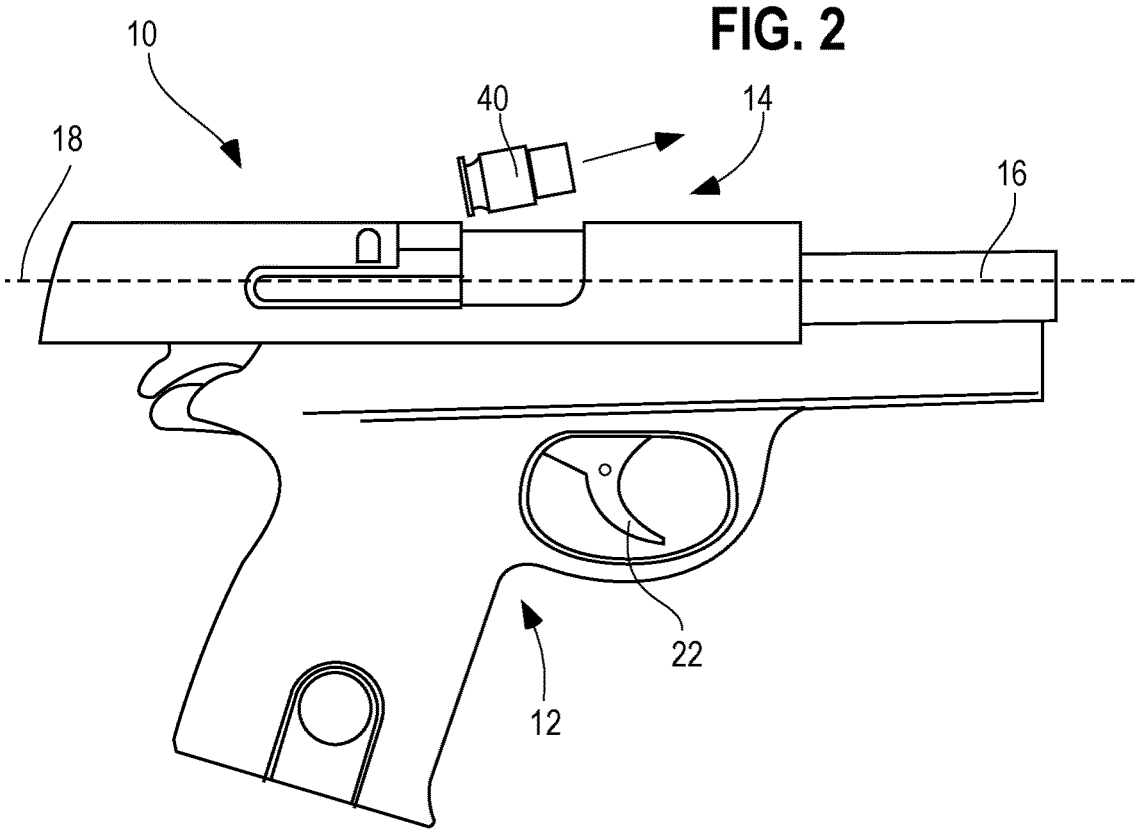
FIG. 2 is a side elevational view of the firearm in the fully recoiled position, in accordance with an embodiment of the present invention.

Referring first to FIGS. 1 and 2, a semiautomatic firearm or pistol 10 is shown, generally referred to hereinafter as the firearm 10. The firearm 10 comprises a frame 12, a slide 14, a barrel 16, and an internal fire control mechanism (not shown). The barrel 16 is disposed at the front aperture of the slide 14 and is cooperatively linked therewith, and, together with the slide 14, defines a longitudinal firing axis 18. The barrel 16 has a rearward end adapted for receiving an ammunition cartridge. A trigger 22 is pivotally mounted to the frame 12 to actuate the fire control mechanism to fire the firearm 10. The frame 12 is fabricated of a polymer material, metal, or a combination of polymer and metal.

The slide 14 is fitted to opposingly positioned rails (not shown) of the frame 12 to effect the reciprocal movement of the slide 14 along a longitudinal firing axis 18. The rails extend along the underside of the slide 14 in the longitudinal direction and are cooperative with the frame 12 to allow the cycling of the slide 14 between forward (battery) and rearward (retired) positions. The firearm 10 also includes an internal locking block 1400 in cooperation with the slide 14 and the barrel 16, which is configured to lock the barrel 16 to the slide 14 prior to firing.

The cooperation of the frame 12, the slide 14, the barrel 16, and the firing mechanism during the loading, firing of a cartridge, and ejecting of a spent casing 40 for the firearm 10 of the present type can be understood by referring to U.S. Pat. Nos. 7,617,628 (Curry) and 6,993,864 (O'Clair et al.), the entirety of which are incorporated herein by reference. The cooperation of a takedown lever 600 with the trigger assembly can be understood by referring to U.S. Pat. No. 7,392,611 (Curry), the entirety of which is incorporated herein by reference.

Figure 3:
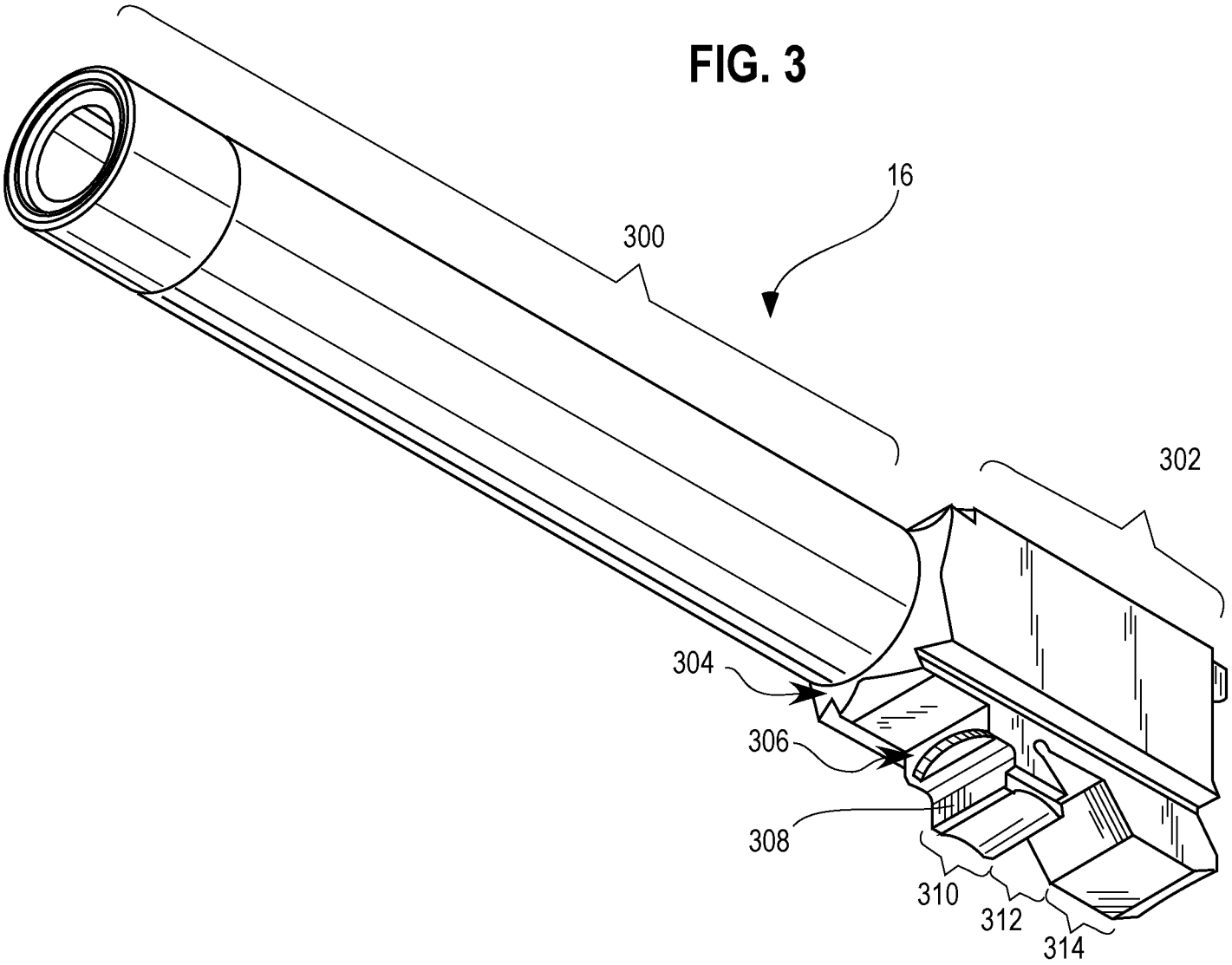
FIG. 3 is a perspective view of a barrel of the firearm in one embodiment of the present invention.
Figure 4:
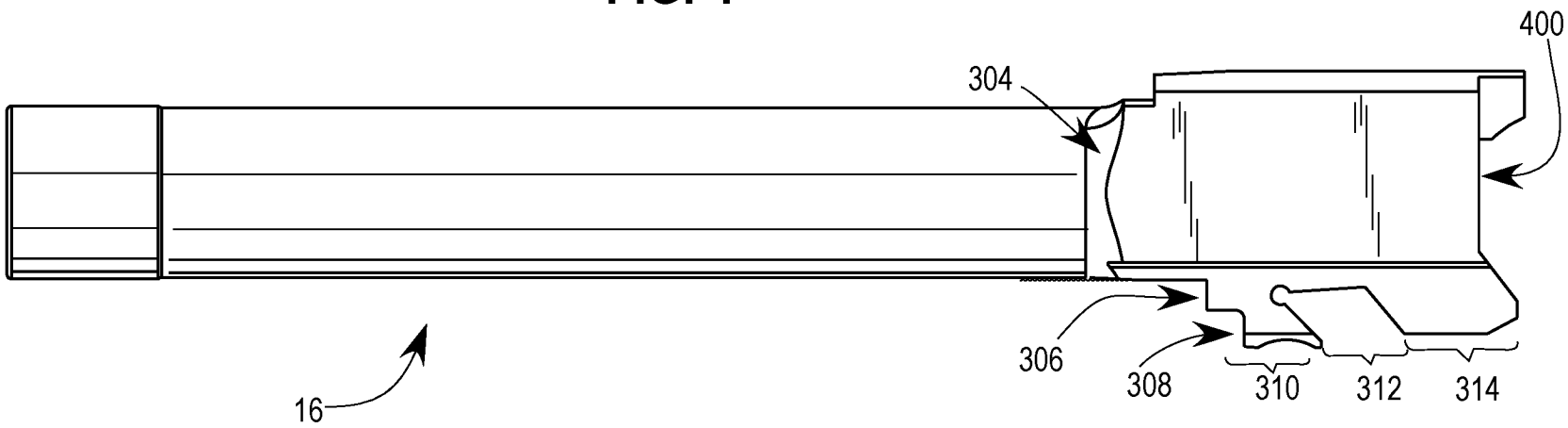
FIG. 4 is a side elevational view of the barrel of the firearm.
Figure 5:
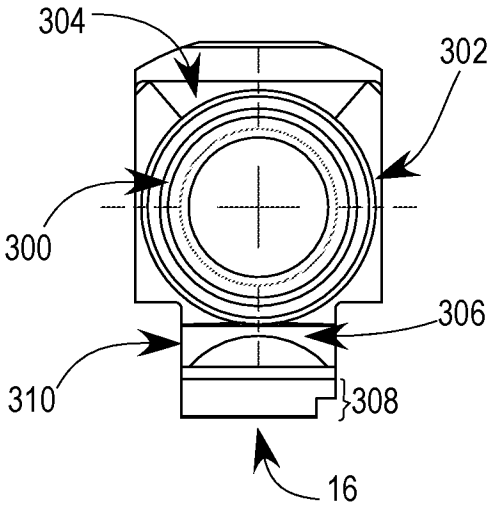
FIG. 5 is a front elevational view of the barrel of the firearm.

Referring next to FIGS. 3, 4 and 5, a perspective view, a side elevational view, and a front elevational view of the barrel 16 are respectively shown. Shown are the barrel 16, a front portion 300, a rear portion 302, a front end face 304, a follower lug front face 306, a follower notch 308, a follower lug 310, a recess groove 312, a rear lug 314, and a rear end face 400.

The barrel 16 includes the tubular front portion 300, and the rear portion 302 with a generally rectangular exterior profile. The rear portion 302 includes the front end face 304 where the rear portion 302 intersects the front portion 300, and the rear end face 400 at a rear end of the rear portion 302 of the barrel 16. The rear portion 302 includes two lugs extending from the underside of the rear portion 302: the follower lug 310 proximate to the front end face 304, and the rear lug 314 proximate to the rear end face 400. As known in the prior art, the follower lug 310 is configured to receive an end of the recoil spring assembly (not shown). Follower lug 310 receives a recoil spring guide rod head and acts as a centering pilot for the recoil assembly as one reassembles the slide assembly onto the frame 12. Once the slide is back on the frame 12, the recoil spring guide rod only contacts primary notch 608 of the takedown lever 600. In the present invention, the follower lug front face 306 extends downward from an underside of the rear portion 302 of the barrel 16 proximate to the front end face 304, forming a surface substantially perpendicular to the underside face of the rear portion 302, and facing towards the front portion 300 of the barrel 16. In the embodiment shown in FIGS. 3-5, the recoil spring guide rod head is received by an arcuate indentation in the follower lug front face 306.

The follower lug 310 also includes the follower notch 308 in a bottom portion of the follower lug front face. The follower notch 308 extends rearward from the follower lug front face 306. In one embodiment, when viewed from a side of the barrel 16 as shown in FIG. 4, the follower notch 308 begins 0.1 inches vertically downward from the intersection of the follower lug front face 306 with the underside of the rear portion 302 of the barrel 16. In one embodiment the notch extends horizontally 0.124" towards the rear end face 400 of the barrel 16. The notch is formed of substantially perpendicular surfaces: a vertical follower lug face facing frontwards, and a horizontal follower lug face facing downwards. The corners formed by face intersections may be rounded. A bottom surface of the follower lug 310 extends rearward from the follower notch 308, and is generally oriented in a horizontal plane. The bottom surface of the follower lug 310 may include an arcuate surface as shown in FIG. 4. A follower lug rear face is angled towards the front of the barrel 16, as shown in FIG. 4.

The rear lug 314 extends downward from the underside of the rear portion 302 of the barrel 16 proximate to the rear end face 400 (i.e. distal to the front portion 300 of the barrel 16), and typically includes a rear lug front surface 2110 and a rear lug rear surface 2108 that are angled towards the front of the barrel 16, as shown in FIG. 4. The rear lug rear surface 2108 extends past the rear of the barrel 16. A rear lug bottom surface 2112 is generally flat and oriented in a horizontal plane.

The recess groove 312 is formed between the follower lug 310 and the rear lug 314. The shape and extent of the recess groove 312 and juxtaposed surfaces of the follower lug 310 and rear lug 314 are configured to cooperate with an upper projection 1402 of the locking block 1400 during recoil, with the rear face of the follower lug 310 contacting the upper projection 1402 of the locking block 1400 and guiding the rear portion 302 of the barrel 16 downwards such that the upper projection 1402 generally fits within the recess groove 312. The operation of the firearm 10 during firing and recoil is described further below in FIGS. 13-20.

The rear lug 314 is further configured such that when the firearm 10 is in the locked position prior to firing, a front portion of the rear lug bottom surface 2112 is juxtaposed with a rear portion of a top surface of the upper projection 1402 of the locking block 1400, whereby the barrel 16 is supported on the rear portion of the upper projection 1402. The rear lug 314 is further configured such that the barrel 16 remains supported by the upper projection 1402 during an initial portion of the recoil stage, as described further below in FIGS. 13-16.

Figure 6:
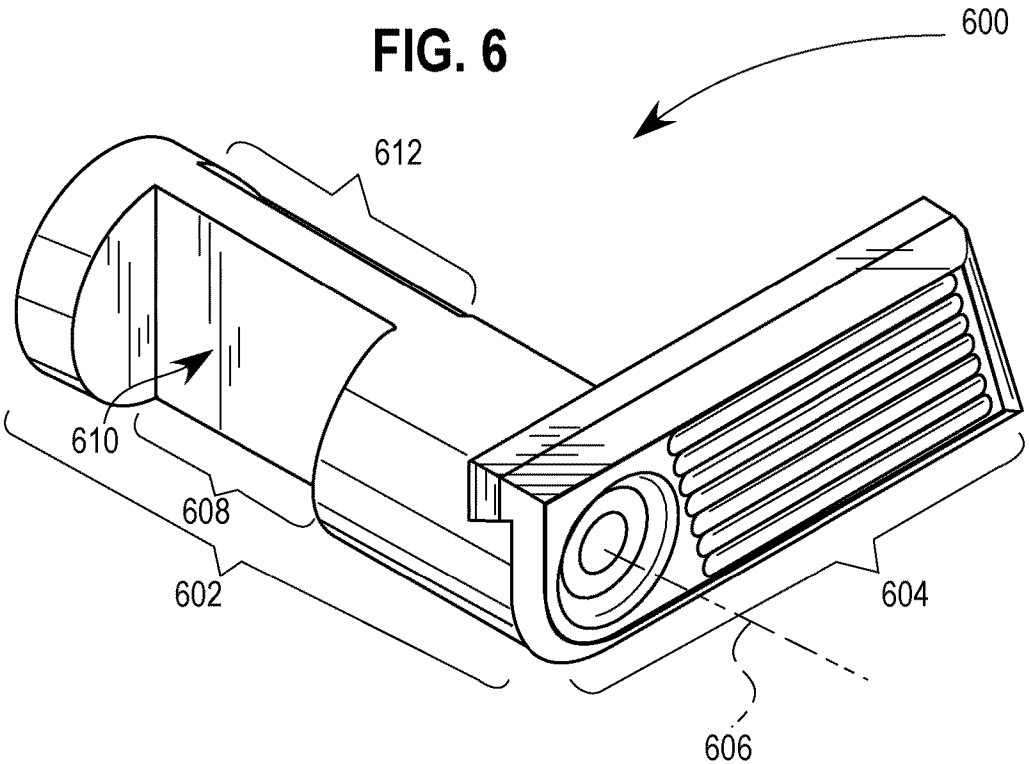
FIG. 6 is a perspective view of a takedown lever of the firearm in accordance with one embodiment of the present invention.
Figure 7:
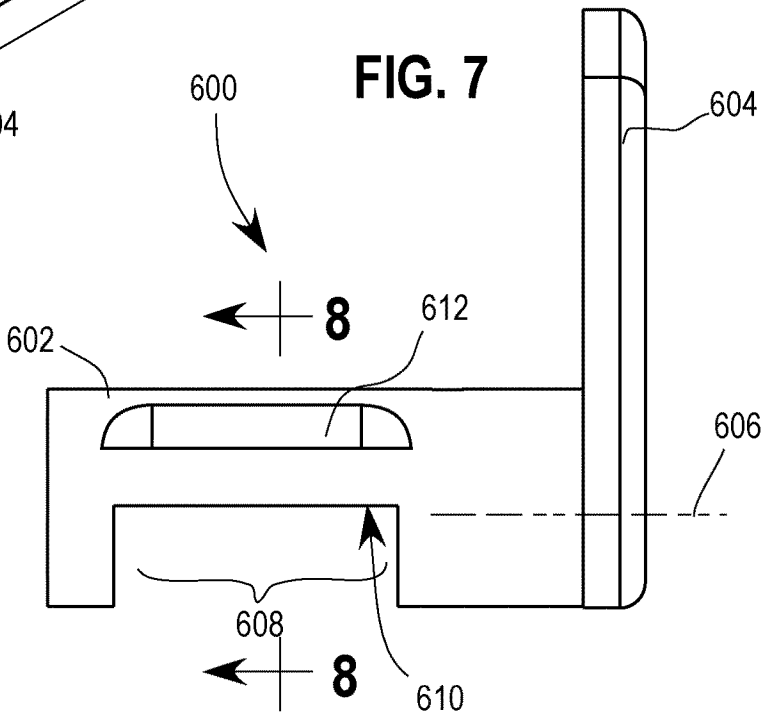
FIG. 7 is a plan view of the takedown lever.
Figures 8, 9:
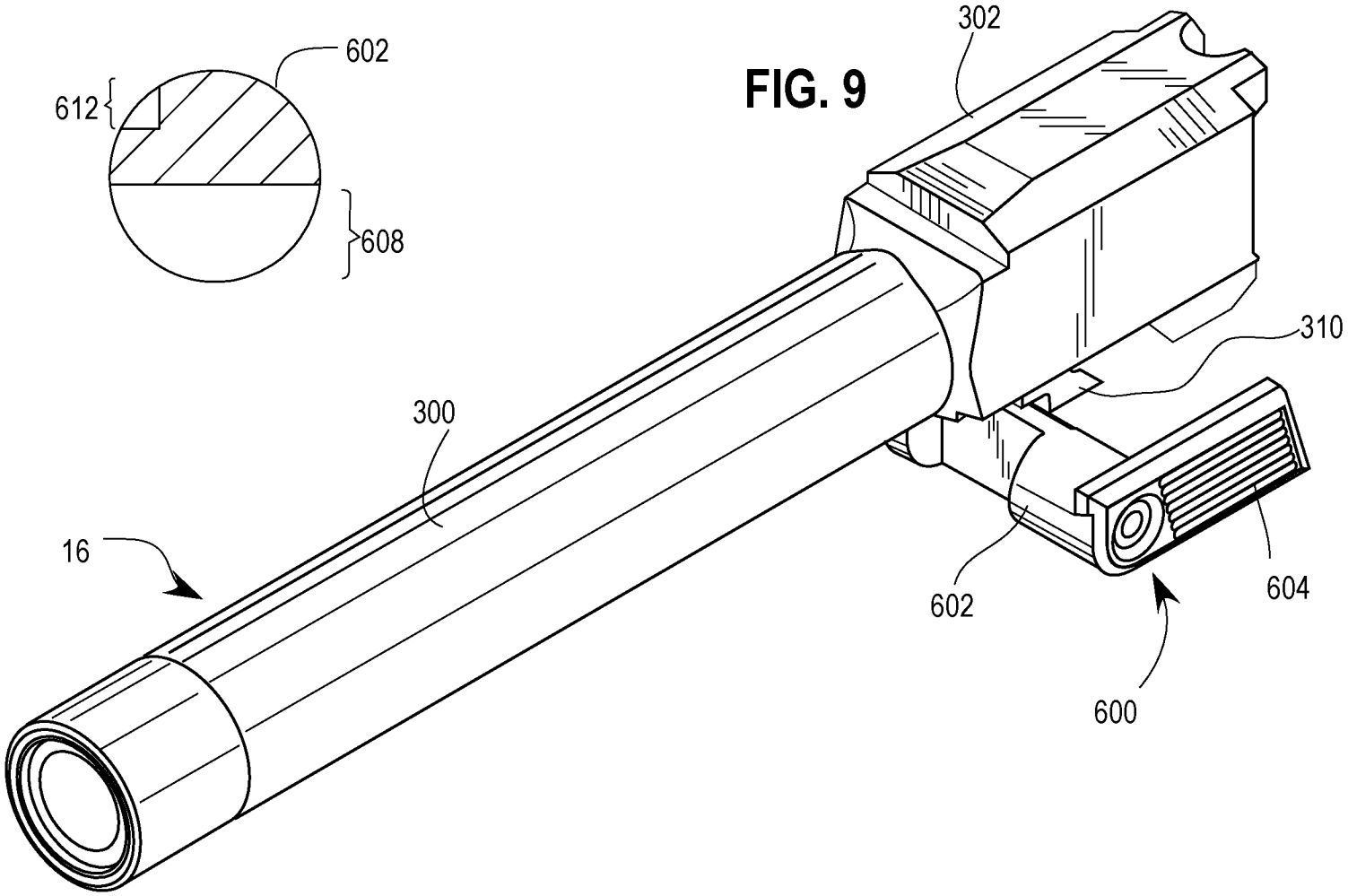
FIG. 8 is a cross-sectional view of the takedown lever.
FIG. 9 is a perspective view of a barrel assembly comprising the barrel and the takedown lever, in accordance with one embodiment of the present invention.

Referring next to FIGS. 6-8, a perspective view, a plan view, and a section view of the takedown lever 600 are shown respectively in one embodiment of the present invention. Shown are a pin 602, an ear 604, a pin longitudinal axis 606, a primary notch 608, a minor surface 610, and a second notch 612.

As is known in the prior art, the takedown lever 600 primarily comprises the cylindrical pin 602, which when installed in the firearm 10 is laterally positioned through the locking block 1400 of the firearm 10. The pin 602 includes the primary notch 608 including the minor surface 610 that is substantially flat and which extends along at least a portion of the longitudinal axis 606 of the pin 602. In cross-section, as shown in FIG. 8, the notch results in a generally semicircular section of the pin 602 at the notch location.

The prior art takedown notch also includes the ear 604, one end of which is coupled to one end of the takedown pin 602, forming an L-shape. The ear 604 extends substantially radially from the longitudinal axis 606 of the takedown pin 602 (i.e. is perpendicular to the longitudinal axis 606) and has a surface that can be engaged by a user and rotated about the longitudinal axis 606, whereby the rotation of the takedown lever 600 allows a portion of the firearm 10 to be disassembled as known in the prior art. In the locked position, the ear 604 is generally horizontal and flush with the exterior of the frame 12, as known in the prior art.

In accordance with one embodiment of the present invention, the pin 602 also includes the second notch 612. The second notch 612 is oriented substantially parallel to the takedown pin longitudinal axis 606, and in cross-section forms a shallow V-shape, with the legs of the V generally perpendicular and one leg of the V parallel to the face of the primary notch 608, forming two surfaces: a generally horizontal second notch face and a generally vertical second notch face. The ends of the second notch 612 may be tapered, as shown in FIG. 7, for example, as part of a milling technique or to eliminate stress risers at termination points. As shown in FIGS. 6-8, when the takedown lever 600 is installed in the locking block 1400 of the firearm 10 and the minor surface 610 of the primary notch 608 is oriented vertically (thus the takedown ear 604 is substantially horizontal), the second notch 612 has one substantially vertical face facing rearward and one substantially horizontal face and facing upward.

The addition of the second notch 612 of the takedown lever 600 provides the rear-facing vertical second notch face when the takedown lever 600 is in the assembled position (i.e. the frame 12 is locked). The vertical second notch face is configured to juxtapose with the vertical, frontward-facing face of the follower notch 308 when the firearm 10 is locked prior to firing, as described further below.

Figure 12:
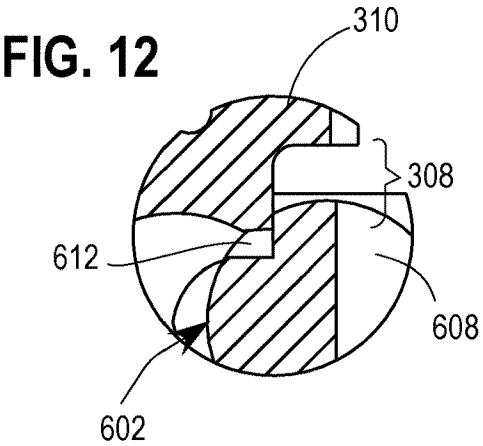
FIG. 12 is a detail of the cross-sectional view shown in FIG. 11.

Referring next to FIGS. 9-12, the combination of the barrel 16 and the takedown lever 600 when assembled in the firearm 10 and the firearm 10 is in the locked position before firing is shown in one embodiment of the present invention. A perspective view is shown in FIG. 9, a rear elevational view is shown in FIG. 10, a longitudinal section is shown in FIG. 11, and a detail of the longitudinal section is shown in FIG. 12. Shown in FIGS. 9-12 are the barrel 16, the front portion 300, the rear portion 302, the follower lug 310, the rear lug 314, the takedown lever 600, the pin 602, the ear 604, the second notch 612, and the primary notch 608.

When the barrel 16 and slide 14 are in the forward locked position prior to firing (as shown below in FIGS. 13 and 14), in the present invention contact between the barrel 16 and the takedown lever 600 takes place only between the follower lug 310 and the second notch 612 of the takedown pin 602. More specifically, only the forward-facing, vertical surface of the follower notch 308 contacts the rearward-facing, vertical surface of the second notch 612 of the takedown pin 602. In other words, the geometrical configuration of both the notch in the follower lug 310 and the second notch 612 of the takedown pin 602 are such that, when in the locked position, the vertical faces of the notches contact each other, and additionally, no other surfaces of the barrel 16 and the takedown lever 600 are in contact. For example, the depth of the second notch 612 in the vertical direction is such that the follower lug 310 does not contact the upward-facing surface of the second notch 612.

In one embodiment, the vertical second notch face is located 0.0785 inches from a parallel plane through a center of the pin 602. In another embodiment, the horizontal second notch face is located 0.0785 inches from a parallel plane through the center of the pin 602.

As is described further below in FIGS. 13-20, the configurations of the second notch 612 and the follower lug 310 provide a consistent contact surface location between the takedown lever 600 and the barrel 16. As both surfaces are vertical, contact takes place at the same location every time the firearm 10 is locked in the firing position. Additionally, the contact surfaces prevent the barrel 16 from moving farther forward when in the locked position.

Referring next to FIGS. 13-20, a series of sections and front elevations of a portion of the firearm 10 are shown illustrating the operation of the firearm 10, including the barrel 16, takedown lever 600 , and locking block 1400 of the present invention. Shown are the slide 14, the barrel 16, the follower lug 310, the recess groove 312, the rear lug 314, the takedown lever 600, the locking block 1400, and the upper projection 1402.

Figure 13:
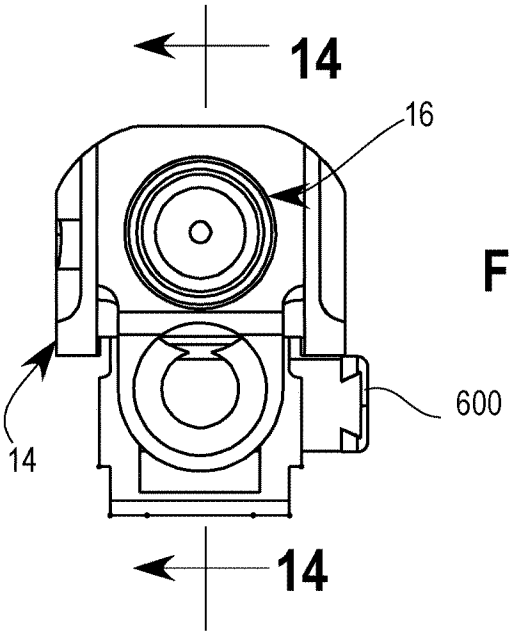
FIG. 13 is a front elevational view of a portion of the firearm in a locked position.
Figure 14:
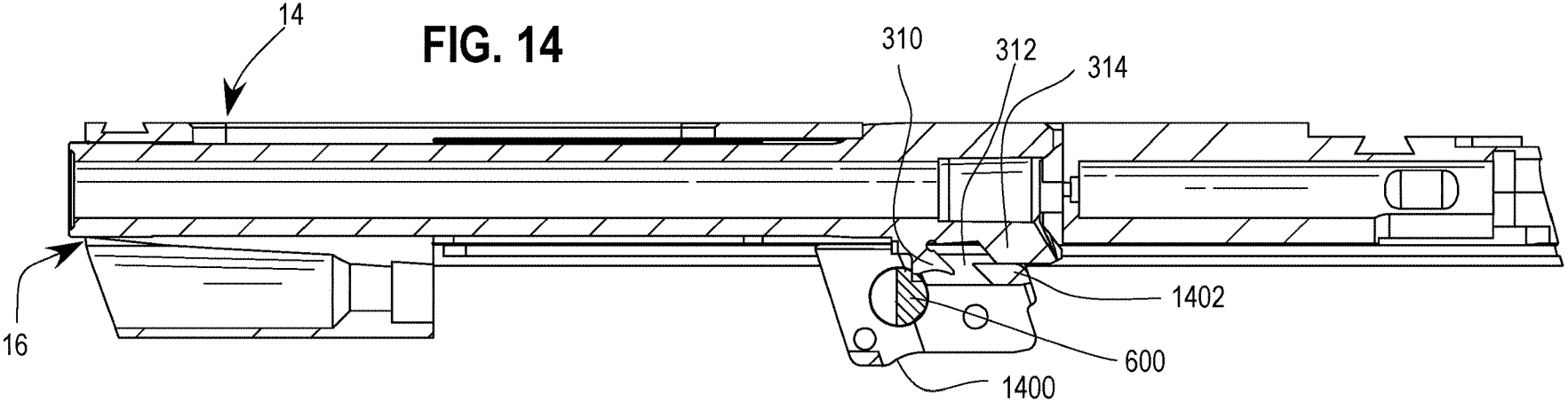
FIG. 14 is a cross-sectional view of the portion of the firearm in the locked position.

Referring first to FIGS. 13 and 14, the firearm 10 is in the locked position prior to firing. As shown previously in FIGS. 9-12, the barrel 16 is moved forward, causing the vertical face of the follower notch 308 to contact and bear against the vertical face of the second notch 612 of the takedown lever 600. As previously described, there is no additional contact between the barrel 16 and the takedown lever 600. Additionally, as previously described in FIGS. 3-5, the rear lug 314 of the barrel 16 is configured such that the front portion of the rear lug 314 is supported on the rear portion of the upper projection 1402 of the locking block 1400. The barrel 16 is thereby restrained against forward movement only by the contact between the follower lug 310 and the takedown lever 600, and restrained against downward movement only by the contact between the rear lug 314 and the upper projection 1402.

Figure 15:
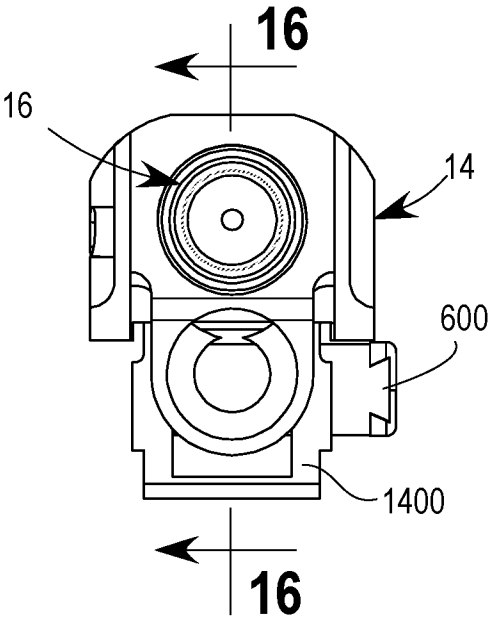
FIG. 15 is a front elevational view of a portion of the firearm in an initial recoil position.
Figure 16:
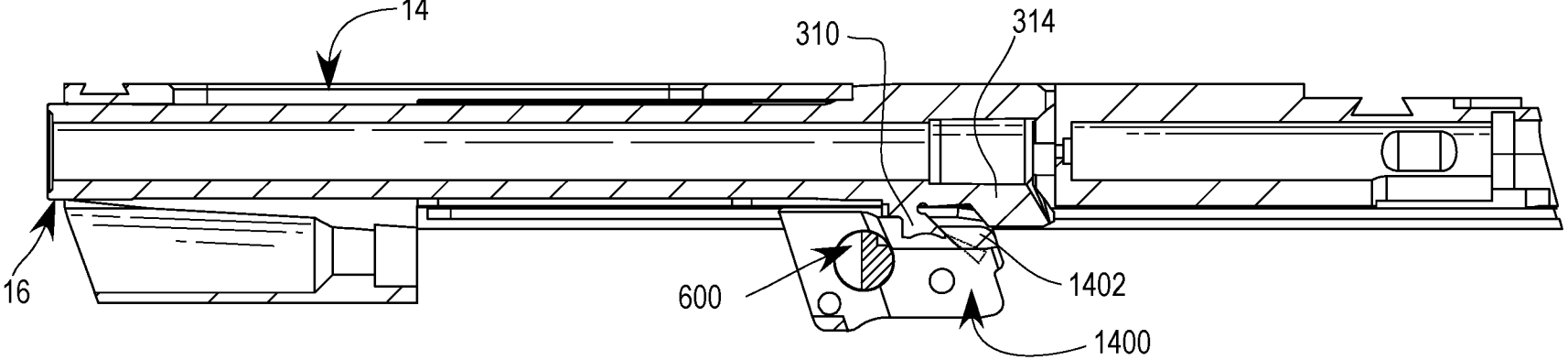
FIG. 16 is a cross-sectional view of the portion of the firearm in the initial recoil position.

Referring next to FIGS. 15 and 16, during the initial recoil impulse after firing the firearm 10, the barrel 16 and slide 14 travel rearward generally along the firing axis 18. As the barrel 16 and slide 14 travel rearward, for a period of time the barrel 16 continues to be restrained against downward movement as the rear lug 314 slides along the surface of the upper projection 1402 of the locking block 1400. As the barrel 16 continues to travel rearward, the rear angled surface of the follower lug 310 contacts the forward angled surface of the upper projection 1402 of the locking block 1400, and the barrel 16 starts to angle downward as guided by the contact between the locking block 1400 and the follower lug 310. The width of the recess groove 312 between the follower lug 310 and the rear lug 314 is configured such that when the follower lug 310 contacts the upper projection 1402, the rear lug 314 is positioned such that the rear lug 314 also slides downward, and is not prevented from sliding downward by contact with the rear portion of the upper projection 1402.

Figure 17:
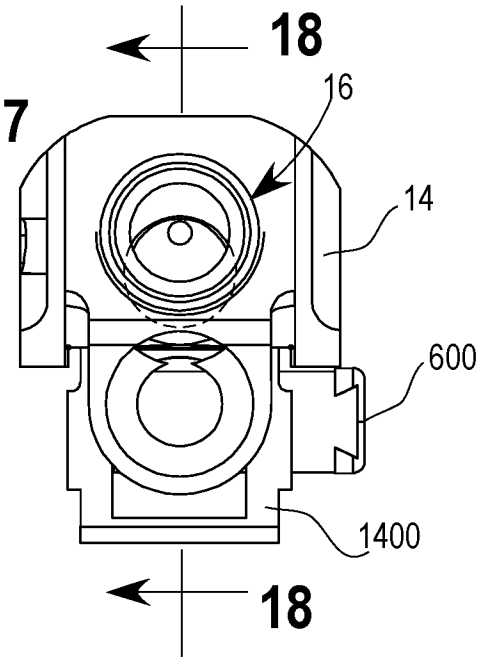
FIG. 17 is a front elevational view of the portion of the firearm in an intermediate recoil position.
Figure 18:
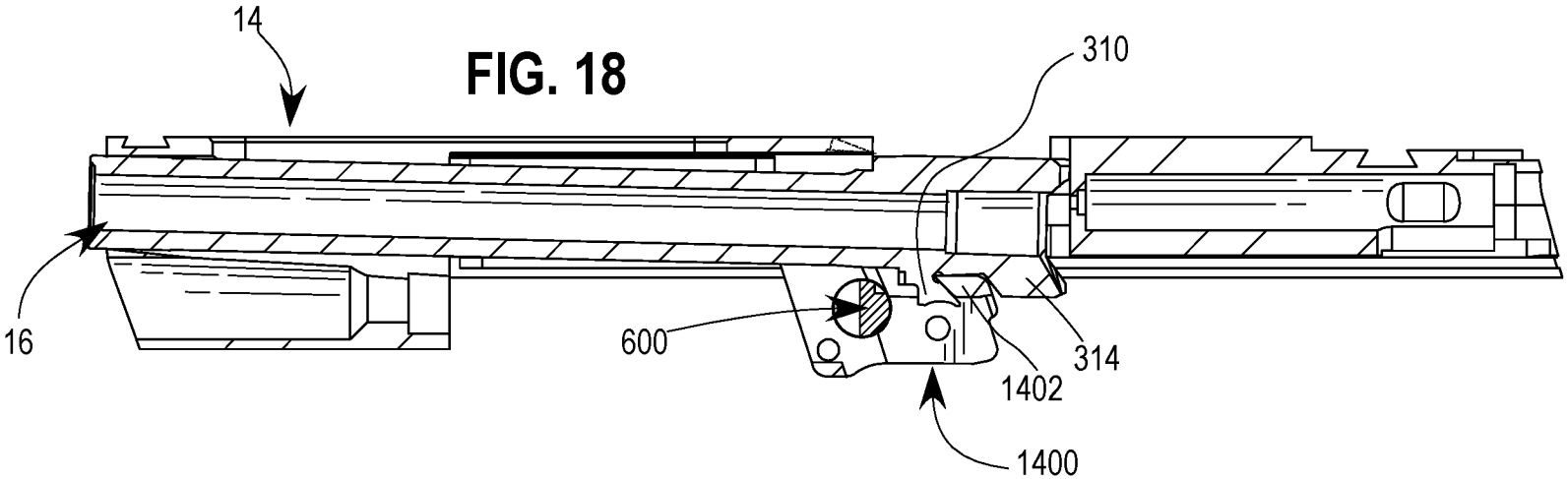
FIG. 18 is a cross-sectional view of the portion of the firearm in the intermediate recoil position.

Referring next to FIGS. 17 and 18, the barrel 16 has continued to travel rearward and at a downward angle until the travel is stopped by contact between the recess groove 312 and the top surface of the upper projection 1402 of the locking block 1400. In this position, the barrel 16 is tilted downwards towards the rear of the firearm 10 to the fullest extent. The barrel 16 and slide 14 remain locked together.

Figure 19:
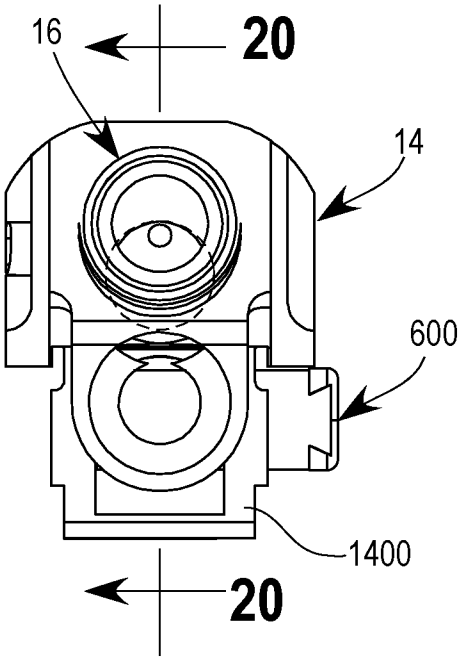
FIG. 19 is a front elevational view of the portion of the firearm in a final recoil position.
Figure 20:
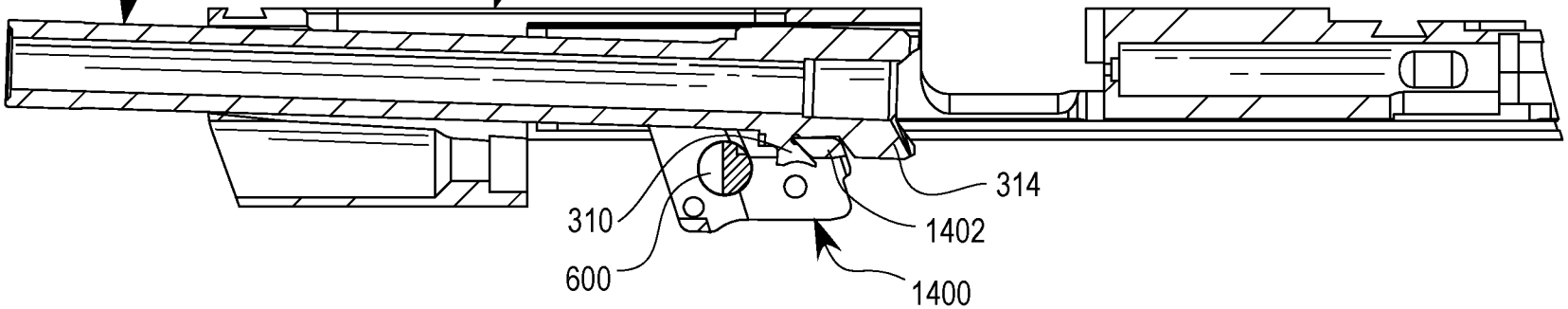
FIG. 20 is a cross-sectional view of the portion of the firearm in the final recoil position.

Referring next to FIGS. 19 and 20, the downward tilt of the barrel 16 allows the slide 14 to unlock from the barrel 16. The rearward movement of the barrel 16 has been arrested by the contact between the upper projection 1402 and the recess groove 312. The slide 14 then continues to travel rearward and eject the spent cartridge. The firearm 10 then loads the next cartridge (not shown) and returns to the locked position of FIGS. 13 and 14.

Referring again to FIGS. 13-20, the present invention, including the modifications to the barrel 16 and the takedown lever 600, increases the accuracy of the firearm 10. The addition of the follower notch 308 and of the second notch 612 of the takedown lever 600 causes the barrel 16 to be locked in a precise position each time the firearm 10 is locked prior to firing. The precise position results in less variation in rearward movement of the barrel 16 after firing.

Additionally, the invention increases the dwell time of the firearm 10. The dwell time is the time period after firing when the barrel 16 and slide 14 travel together in a fixed relationship. A longer dwell time ensures that the orientation of the barrel 16 relative to the slide 14 remains constant until well after a bullet has exited the barrel 16, keeping the slide/barrel relationship constant throughout the firing process and thus increasing accuracy.

The increase in length of the rear lug 314 also provides a precise support, supporting the barrel 16 against downward movement and ensuring that the barrel 16 is supported vertically during the initial firing stages, as the rear lug 314 slides along the upper projection 1402. Maintaining the barrel 16 in the substantially horizontal position during the initial firing increases the accuracy of the firearm 10, as early tilting of the barrel 16 downward, as occurs with the firearm 10 configurations known in the art, alters the trajectory of the bullet. The contact between the upper projection 1402 and the rear lug 314 in the locked position also results in consistent locking pressures on the barrel 16, again limiting variations in movement during the lockup and firing periods, which in turn increases the accuracy of the firearm 10.

Firearms of the prior art use only a ramped surface bearing against a rounded surface of the takedown lever 600 to maintain the relationship between the barrel 16 and the slide 14 after firing, resulting in a shorter dwell time. The prior art design requires that a constant forward force act on the barrel 16 in order for the ramped surface to bear against the round surface of the takedown lever 600. Variations in the cartridge pressure curve from shot to shot result in variable vertical lock-up forces, which in turn causes inconsistent accuracy.

Additionally, in some embodiments of the present invention the external diameter of the front portion 300 of the barrel 16 is increased approximately 0.005". The external diameter results in less movement of the barrel 16 within the slide 14 during the locked position and during an initial firing period. The reduction in movement within the barrel 16 ("wobble") also increases accuracy by lessening the variations of movement within the firearm 10 during the lockup and firing periods.

In some embodiments, the accuracy of the firearm 10 of the present invention is increased to impact within a 4" diameter circle from 50 meters for at least 90% of the firing attempts. In some embodiments, the accuracy is increased to impact within a 2" diameter circle from 50 meters for at least 90% of the firing attempts.

Figure 21:
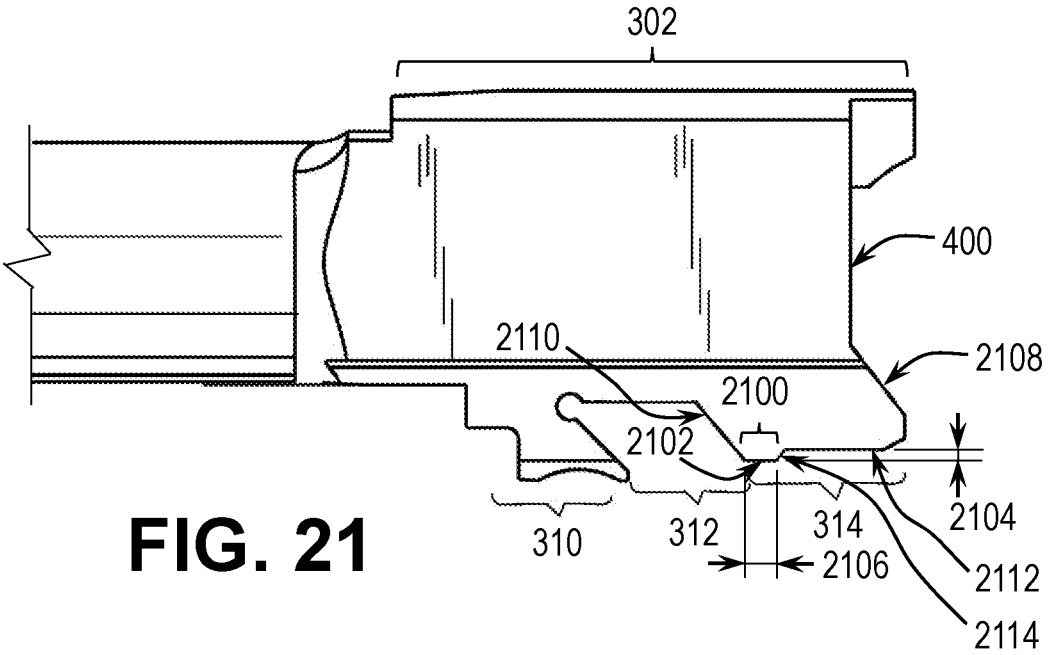
FIG. 21 is a side elevational view of a rear portion of a barrel of the firearm in a second embodiment of the present invention.
Figure 22:
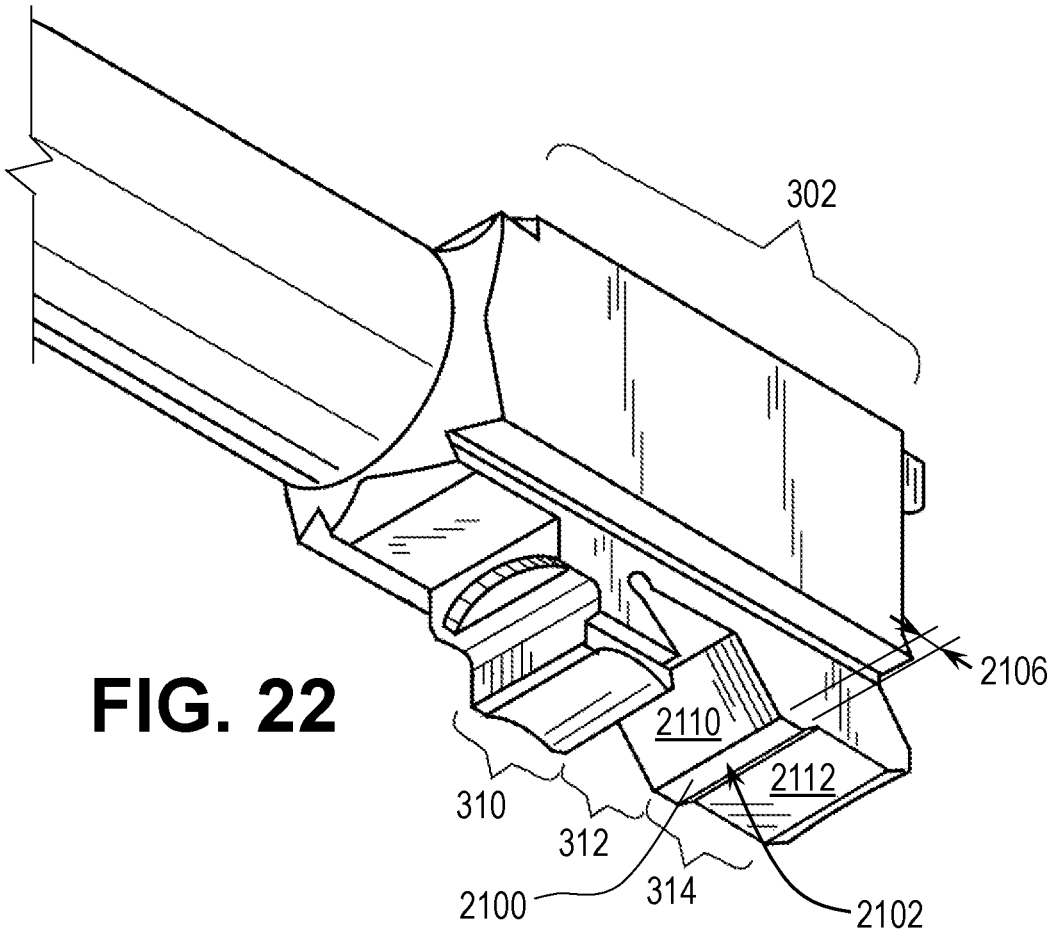
FIG. 22 is a perspective view of the rear portion of the barrel of FIG. 21.

Referring next to FIGS. 21 and 22, a side elevational view and a perspective view, respectively, of the rear portion 302 of the barrel 16 are shown in a second embodiment of the present invention. Shown are the rear portion 302, the follower lug 310, the recess groove 312, the rear lug 314, the rear end face 400, a fitting pad 2100, a fitting pad surface 2102, a fitting pad height 2104, a fitting pad length 2106, a rear lug rear surface 2108, a rear lug front surface 2110, a rear lug bottom surface 2112, and a transition surface 2114.

In the embodiment shown, the fitting pad 2100 dimensions given are for use in a Smith & Wesson® M&P® 9 mm firearm, but it will be understood that the fitting pad 2100 dimensions and other parameters of the fitting pad 2100 and rear lug 314 may be modified for use with other firearm types.

As with the previous embodiment, the rear lug 314 extends downward from the underside of the rear portion 302 proximate to the rear end face 400, and typically includes the rear lug front surface 2110 and the rear lug rear surface 2108 that are angled downwards away from the front of the barrel 16, as shown in FIGS. 21 and 22. The rear lug rear surface 2108 extends past the rear of the barrel 16. The rear lug 314 includes the rear lug bottom surface 2112 on a portion of the underside of the rear lug 314 proximate to the rear of the barrel 16. The rear lug bottom surface 2112 in one embodiment is flat, although the rear lug bottom surface 2112 may be curved or otherwise shaped. The rear lug bottom surface 2112 in the present embodiment is parallel to the fitting pad surface 2102, although in other embodiments the rear lug bottom surface 2112 may not be parallel to the fitting pad surface 2102, for example the rear lug bottom surface 2112 may be angled upwards to provide greater clearance with respect to the locking block 1400. The barrel embodiment of FIGS. 21 and 22 differs from the previous embodiment in that the fitting pad 2100 projects downwards from a fixed-length portion of the rear lug bottom surface 2112 proximate to the front of the barrel 16. As a result, an underside of the rear lug 314 has two generally rectangular parallel surfaces: The fitting pad surface 2102, located on the portion of the rear lug 314 proximate to the front of the firearm 10, and the rear lug bottom surface 2112, located on the portion of the rear lug 314 distal to the front of the firearm 10, with the rear lug bottom surface 2112 located at an upward elevation in relation to the fitting pad surface 2102. A perpendicular distance between the fitting pad surface 2102 and the rear lug bottom surface 2112 is the fitting pad height 2104. As a result, the fitting pad 2100 is a projection that extends the width of the underside of the rear lug 314 at a front portion of the rear lug 314 and extends downwards from the front portion of the rear lug 314. In the embodiment shown, a transition between the fitting pad surface 2102 and the rear lug bottom surface 2112 is a linear (straight) transition, whereby the resulting transition surface 2114 is a rectangular shape. The transition surface 2114 is angled towards the rear of the barrel 16, such that the fitting pad 2100 is tapered in the downwards direction. The fitting pad length 2106 (a length of the fitting pad surface 2102) is dependent on the desired dwell time of the firearm 10 and the locking block geometry. In the current embodiment the fitting pad length 2106 is 0.90 inches.

The fitting pad 2100 is integral to the rear lug 314 and is therefore of the same material of the rear lug 314. In the current embodiment, the fitting pad height 2104 (the distance between the fitting pad surface 2102 and the rear lug bottom surface 2112) is 0.015", although it will be understood that the fitting pad height 2104 will vary depending on the type of firearm 10 and other variables. The fitting pad height 2104 can be made to be as much as 0.030" or more depending on slide-to-frame vertical tolerances. The fitting pad height 2104 is configured to ensure adequate downward protrusion of the fitting pad 2100 to make solid contact with the mating surface of the frame locking block 1400 regardless of the firearm manufacturer's slide-to-frame vertical tolerance range. While in the present embodiment the fitting pad height 2104 is defined with respect to the rear lug bottom surface 2112, the fitting pad height 2104 may also be defined with respect to a central axis of a bore of the barrel 16.

In the configuration of FIGS. 21 and 22, the barrel 16 including the fitting pad 2100 is intended to be used as a substitute for the barrel originally supplied with the firearm 10. Typically, barrels that are substituted for the original barrel lack a precise vertical fit of the rear lug 314 to the upper projection 1402 of the locking block 1400, resulting in wobble and other misalignments that negatively affect firing accuracy. To solve this problem, the rear lug 314 has been modified to include the fitting pad 2100. The fitting pad 2100 allows for exact modification of the rear lug 314 to obtain a precise fit of the rear lug 314 to the upper projection 1402 of the frame 12, as shown further below in FIG. 24. Extending the height of the entire rear lug 314 would require potential modification of the entire underside of the rear lug 314, which would have a greater chance of introducing irregularities to the underside surface. Having only the fitting pad 2100 contact the upper projection 1402 of the locking block 1400 requires that only a small portion of the rear lug 314 need be modified for precise fit. The fitting process is described further below in FIG. 23. Additionally, the transition surface 2114 between the fitting pad surface 2102 and the rear lug bottom surface 2112 is a rectangular surface to aid the user in evenly modifying the fitting pad height 2104.

Figure 23:
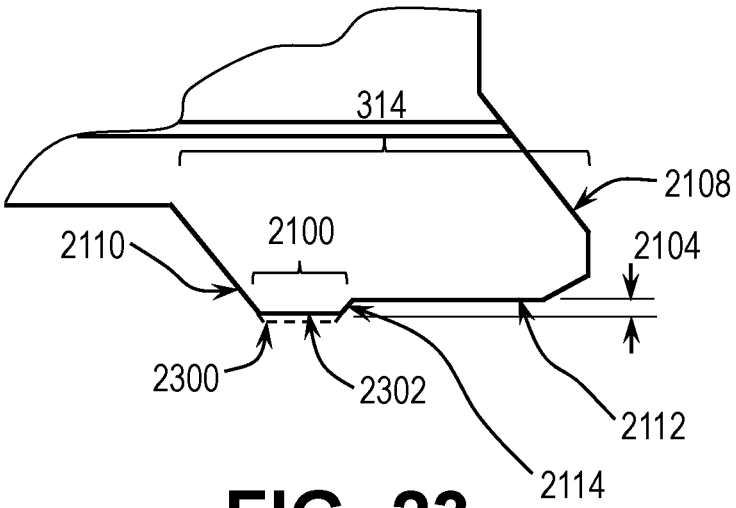
FIG. 23 is a side elevational view of the rear lug of the second embodiment of the barrel.

Referring next to FIG. 23, a side elevational view of the fitting pad 2100 with a modified height is shown. Shown are the rear lug 314, the rear lug rear surface 2108, the fitting pad 2100, the rear lug front surface 2110, the fitting pad height 2104, the rear lug bottom surface 2112, an original fitting pad surface 2300 and a modified fitting pad surface 2302.

To account for variations in manufacture, the fitting pad 2100 is modifiable so that the user can reduce the fitting pad height 2104 to exactly fit the rear lug 314 to the upper projection 1402 of the locking block 1400 and eliminate excess vertical play between the barrel 16, slide 14 and frame 12. As shown in FIG. 23, the fitting pad 2100 has been modified to remove a portion of the fitting pad material at the original fitting pad surface 2300, reducing the fitting pad height 2104. The original fitting pad surface 2300 is shown as a dashed line. The current fitting pad surface 2302, after a portion of the fitting pad material has been removed, is shown as a solid line. As shown in FIG. 23, the modification has resulted in a reduction of the fitting pad height 2104.

As shown in FIG. 23, a height of the fitting pad relative to the rear lug bottom surface 2112 has been reduced by removing material from the original fitting pad surface 2300, resulting in the new fitting pad surface 2302. To remove the material, the fitting pad 2100 can be hand filed, milled or sanded down an amount necessary to precisely mate the barrel 16 to the individual slide 14 and frame 12. As the fitting pad 2100 widens upward, the removal of the original fitting pad surface 2300 slightly increases the fitting pad length 2106 and therefore does not decrease the dwell time. The transition surface 2114 is rectangular, providing a visual indication of even removal of material from the fitting pad 2100. If material is unevenly removed from the fitting pad 2100, the transition surface 2114 will no longer be rectangular, so that the user can have visual confirmation that the fitting pad material is being removed evenly when the transition surface 2114 remains rectangular.

During the fitting process, the barrel 16 is installed in the firearm 10 and is tested for fit. In some embodiments, to determine if the barrel 16 is properly fit the barrel 16 is detached from the frame 12 and the fitting pad surface 2102 is coated with a marking dye such as layout fluid or other suitable marking dye to aid in determining the current fit. The slide 14 (with the barrel 16 installed) is then installed on the frame 12 and dropped into battery. The barrel 16 is then removed from the frame 12 and the fitting pad surface 2102 checked. If any portion of the marking dye has been burnished, the fitting pad height 2104 requires adjustment.

In another method of determining if the barrel 16 is properly fit to the frame 12, the slide 14 (including the barrel 16) is positioned on the frame 12 such that the firearm 10 is nearly in battery, i.e., any additional forward movement of the slide drops the frame 12 into battery. A forward force is applied to the slide 14, whereby the slide 14 drops into battery. If the forward force required to drop the firearm 10 into battery is greater than 2 pounds, the fitting pad surface 2102 requires adjustment. In the present embodiment, the forward distance that the barrel 16 moves between the "nearly in battery" position and the battery position is approximately 0.150", although it will be understood that this dimension will vary depending on the specific firearm. This forward distance ensures that the barrel dwell time is at least 10 times than what it present for the equivalent firearm 10 without the fitting pad 2100, yet keeping the forward force required to drop the firearm 10 into battery to no greater than 2 pounds ensures that the slide 14 will reliably return to battery under actual use conditions.

In yet another method of determining if the barrel 16 is properly fit to the frame 12, the slide 14 is retracted approximately 0.010" while the user simultaneously feels for movement of the barrel 16 (relative to the slide 14) at both front and rear ends of the barrel 16. This is also the standard test used to verify proper fit on all semi-automatic pistols that employ a tilting barrel design.

If it is determined that the fitting pad height 2104 requires adjustment, the barrel 16 is removed from the slide 14 and a small thickness of the fitting pad 2100 is evenly removed, for example with a file. The barrel 16 is then re-installed in the firearm 10 and the fit checked again. This process is repeated until the barrel 16 is determined to be properly fit in the frame 12, by either the first or second method. The fitting pad 2100 does not extend the full length (front-to-back) of the rear lug 314 so that less material needs to be removed during the fitting process, and to aid in maintaining a flat surface of the fitting pad 2100.

Figure 24:
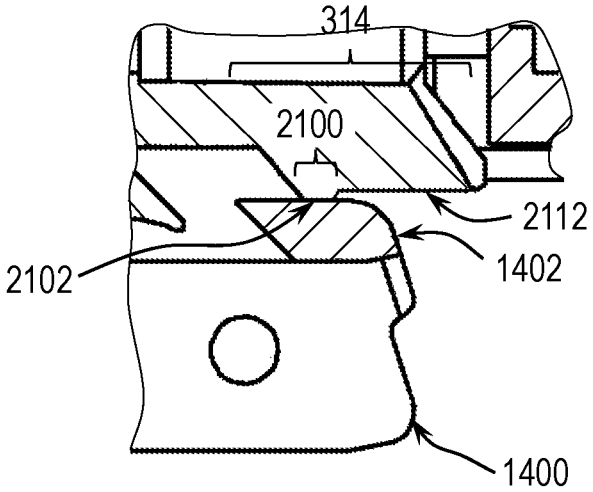
FIG. 24 is a side sectional view of a portion of a firearm in the locked position including the barrel in the second embodiment of the present invention.

Referring next to FIG. 24, a sectional view of a portion of the firearm 10 in the locked position prior to firing is shown with the barrel fitting pad embodiment of FIGS. 21 and 22. Shown are the rear lug 314, the fitting pad 2100, the fitting pad surface 2102, the rear lug bottom surface 2112, the locking block 1400, and the upper projection 1402.

As previously described, when the firearm 10 is in the locked position, the bottom of the rear lug 314 is juxtaposed with and vertically supported by the upper projection 1402 of the locking block 1400 below. In the embodiment of FIGS. 21-24, as the fitting pad 2100 is located at the front portion of the rear lug 314, the rear lug 314 is supported by the fitting pad surface 2102 juxtaposed with the upper surface of the upper projection 1402. The rear lug bottom surface 2112 is located upward of the upper projection 1402 and does not contact the upper projection 1402 during any point of the locking and firing sequence. As the fitting pad 2100 has been precisely fit to the upper projection 1402, using one or both of the methods described above, during operation of the firearm 10 the fitting pad 2100 continues to be supported by the upper projection 1402 during a length of time during recoil (i.e. the dwell time) until the fitting pad 2100 clears the rear edge of the upper projection 1402 and the rear lug 314 slides downward behind the upper projection 1402 as previously described. The fitting pad 2100 is configured such that the fitting pad 2100 does not interfere with the upper projection 1402 after the barrel 16 drops out of battery. The seating of the fitting pad 2100 on the upper projection 1402, as previously described, allows the barrel 16 to move rearward a significant distance and during recoil and also maintain the same pretension and pressure in the barrel 16, resulting in greater accuracy.

While the invention herein disclosed has been described by means of specific embodiments, examples and applications thereof, numerous modifications and variations could be made thereto by those skilled in the art without departing from the scope of the invention set forth in the claims.

What is claimed is:

1. A method for fitting a barrel to a firearm, the barrel including a follower lug extending downward from an underside of a rear portion of the barrel, wherein the follower lug is proximate to a front portion of the barrel, a rear lug extending downward from the underside of the rear portion of the barrel, wherein the rear lug is distal to the front portion of the barrel, whereby a recess groove configured to receiving a projection of a locking block of the firearm is formed between the follower lug and the rear lug, the rear lug including a fitting pad projecting downward from a front portion of the rear lug and including a horizontal fitting pad surface on an underside of the fitting pad, whereby a distance the fitting pad projects downward is a fitting pad height, comprising the steps of:

installing the barrel in a slide of the firearm;

installing the slide on a frame of the firearm;

positioning the slide such that the firearm is not in battery and any forward movement of the slide will drop the firearm into battery;

applying a forward force to the slide, whereby the firearm is dropped into battery;

determining a magnitude of the force; and when the magnitude of the force is greater than 2 pounds, removing the barrel from the firearm and evenly removing material from the fitting pad such that the fitting pad height is decreased.

2. The method for fitting the barrel to the firearm of claim 1, wherein the fitting pad extends a width of the rear lug.

3. The method for fitting the barrel to the firearm of claim 1, wherein the fitting pad is integral with the barrel.

4. The method for fitting the barrel to the firearm of claim 1, wherein the fitting pad is tapered downwards.

5. The method for fitting the barrel to the firearm of claim 1, further comprising a rear lug bottom surface on a rear portion of the rear lug, wherein the rear lug bottom surface is located above the fitting pad surface.

6. The method for fitting the barrel to the firearm of claim 5, wherein a transition surface between the rear lug bottom surface and the fitting pad surface is a linear transition surface, whereby the transition surface is rectangular.

7. The method for fitting the barrel to the firearm of claim 6, wherein the transition surface provides a visual indication of the even removal of material from the fitting pad, and wherein the evenly removing of the material from the fitting pad further comprises visually confirming that the transition surface remains rectangular.

8. The method for fitting the barrel to the firearm of claim 1, wherein the evenly removing of the material from the fitting pad comprises one selected from the group consisting of hand filing, milling or sanding of the fitting pad surface.

9. The method for fitting the barrel to the firearm of claim 1, wherein the dropping of the firearm into battery includes the barrel moving forward 3.81 mm (0.150 inches).

10. The method for fitting the barrel to the firearm of claim 1, further comprising the step of:

after the evenly removing of the material from the fitting pad, repeating the step sequence of installing the barrel, installing the slide, positioning the slide, applying the forward force, determining the magnitude of the force, and evenly removing the material from the fitting pad, at least once.

11. The method for fitting the barrel to the firearm of claim 1, further comprising the step of:

after the evenly removing of the material from the fitting pad, repeating the step sequence of installing the barrel, installing the slide, positioning the slide, applying the forward force, determining the magnitude of the force, and evenly removing the material from the fitting pad, until the magnitude of the force is not greater than 2 pounds.

12. The method for fitting the barrel to the firearm of claim 1, wherein the firearm is a 9 mm firearm.

* * * * *